US005543684A

United States Patent [19]

Kumar et al.

[11] Patent Number: 5,543,684

[45] Date of Patent: Aug. 6, 1996

[54] FLAT PANEL DISPLAY BASED ON DIAMOND THIN FILMS

[75] Inventors: Nalin Kumar, Austin; Chenggang Xie, Cedar Park, both of Tex.

[73] Assignee: Microelectronics and Computer Technology Corporation, Austin, Tex.

[21] Appl. No.: 343,262

[22] Filed: Jun. 20, 1994

Related U.S. Application Data

[63] Continuation of Ser. No. 851,701, Mar. 16, 1992, abandoned.

[51] Int. Cl.[6] ..... H01J 1/30

[52] U.S. Cl. ..... 313/495; 313/309; 313/496; 313/292; 313/346 R

[58] Field of Search ..... 313/495, 422, 313/496, 485, 486, 309, 336, 351, 346 R, 355; 315/169.4; 345/45, 75

[56] References Cited

U.S. PATENT DOCUMENTS

| | | | |
|---|---|---|---|
| 3,259,782 | 7/1966 | Shroff | 313/346 R |
| 3,665,241 | 5/1972 | Spindt et al. | 313/351 X |
| 3,789,471 | 2/1974 | Spindt et al. | 445/52 |
| 4,008,412 | 2/1977 | Yuito et al. | 313/336 X |
| 4,084,942 | 4/1978 | Villalobos | 313/336 X |
| 4,164,680 | 8/1979 | Villalobos | 313/336 |
| 4,498,952 | 2/1985 | Christensen | 313/309 X |
| 4,663,559 | 5/1987 | Christensen | 313/336 |
| 4,687,938 | 8/1987 | Tamura et al. | 250/423 |
| 4,940,916 | 7/1990 | Borel et al. | 313/336 X |
| 4,990,766 | 2/1991 | Simms et al. | 313/336 X |
| 5,141,460 | 8/1992 | Jaskie et al. | 313/309 X |
| 5,142,184 | 8/1992 | Kane | 313/336 X |
| 5,162,704 | 11/1992 | Kobori et al. | 313/336 X |
| 5,180,951 | 1/1993 | Dworsky et al. | 313/355 X |

OTHER PUBLICATIONS

Control of Silicon Field Emitter Shape with isotropically Etched oxide masks, Warren, J. B. Dec. 1989.

Noer, "Electron Field Emission from Broad–Area Electrodes", *Applied Physics* Jan. 1982. pp. 1–24.

Avakyan, et. al., "Angular Characteristics of the Radiation by Ultrarelativistic Electrons in Thick Diamond Single Crystals", *Soviet Technical Physics Letters,* vol. 11, No. 11, Nov. 1985, pp. 574–575.

Djubua, et. al., "Emission Properties of Spindt–Type Cold Cathodes with Different Emission Cone Material", *IEEE Transactions on Electron Devices,* vol. 38, No. 10, Oct. 1991.

Wang, et. al., "Cold Field Emission from CVD Diamond Films Observed in Emission Electron Microscopy", *Electronics Letters,* vol. 27, No. 16, Aug. 1991.

Geis, et. al., "Diamond cold Cathode,", *IEEE Electronic Device Letters,* vol. 12, No. 8, Aug., 1991.

*Primary Examiner*—Sandra L. O'Shea
*Assistant Examiner*—Ashok Patel
*Attorney, Agent, or Firm*—Kelly K. Kordzik; Winstead Sechrest & Minick P.C.

[57] ABSTRACT

A field emission cathode is provided which includes a substrate and a conductive layer disposed adjacent the substrate. An electrically resistive pillar is disposed adjacent the conductive layer, the resistive pillar having a substantially flat surface spaced from and substantially parallel to the substrate. A layer of diamond is disposed adjacent the surface of the resistive pillar.

28 Claims, 13 Drawing Sheets

FIG. 6
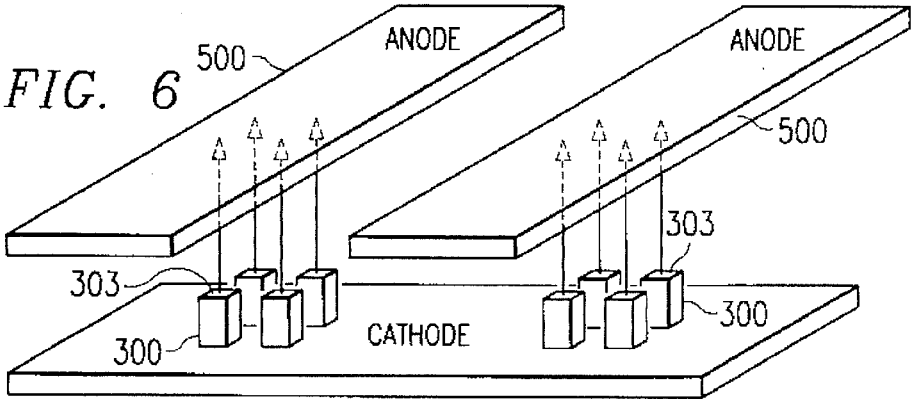
FIG. 7a
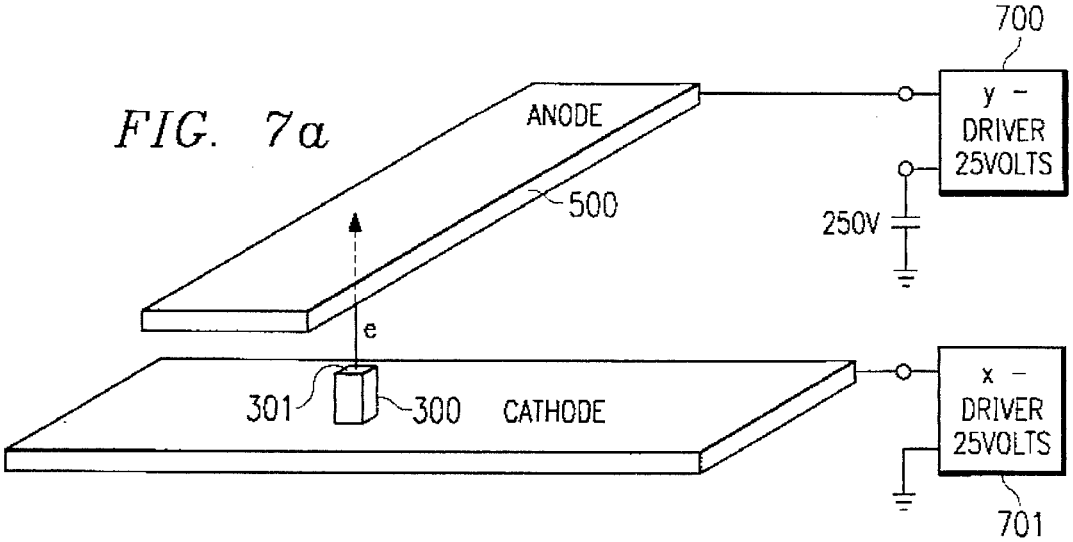
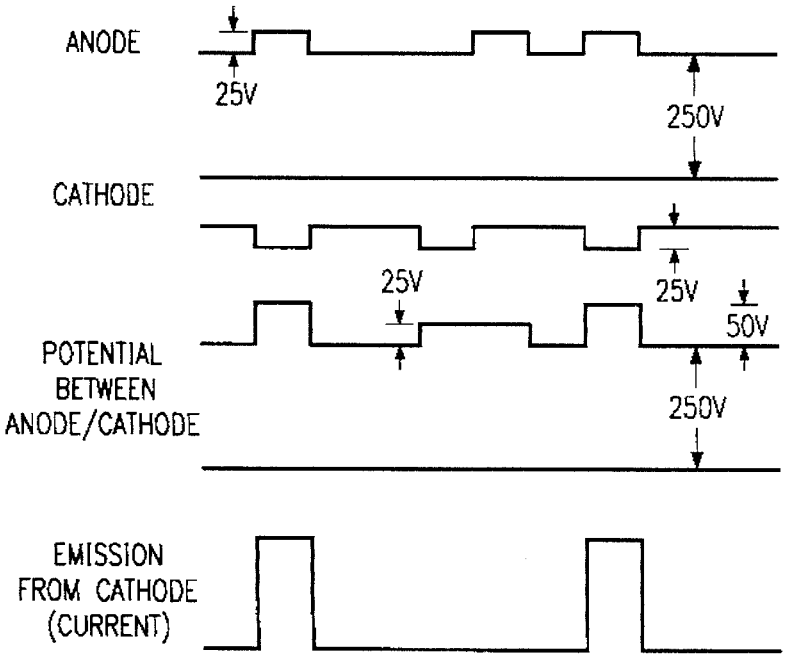
FIG. 7c

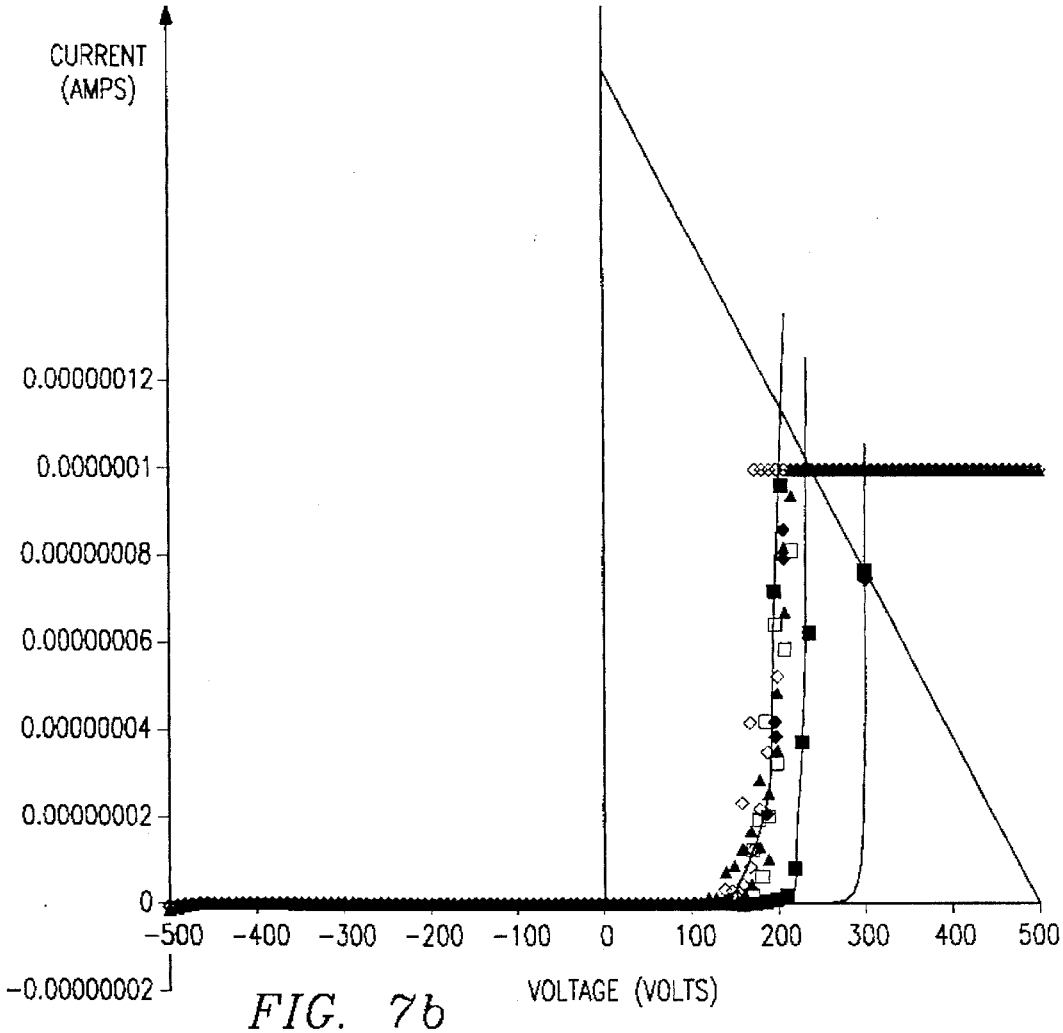
FIG. 7b
FIG. 8
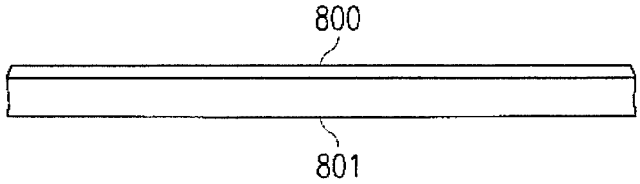
FIG. 9
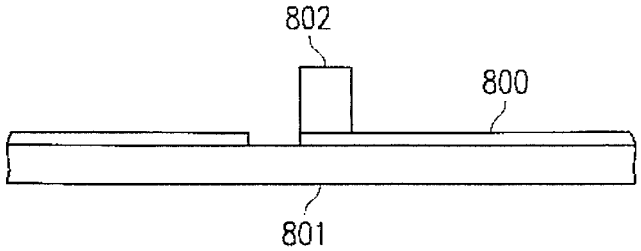

FLAT PANEL DISPLAY BASED ON DIAMOND THIN FILMS

This is a continuation of application Ser. No. 07/851,701, filed on Mar. 16, 1992 now abandoned.

TECHNICAL FIELD OF THE INVENTION

This invention relates in general to flat panel displays for computers and the like and, more specifically, to such displays incorporating diamond film to improve image intensity at low cost.

BACKGROUND OF THE INVENTION

Field emitters are useful in various applications such as flat panel displays and vacuum microelectronics. Field emission based flat panel displays have several advantages over other types of flat panel displays, which include low power consumption, high intensity and low projected cost. Current field emitters using micro-fabricated metal tips suffer from complex fabrication process and very low yield, thereby increasing the display cost. Thus, an improved field emitter material and device structure, and a less complex fabrication process is clearly desired. This invention addresses all of these issues.

The present invention can be better appreciated with an understanding of the related physics. In general, the energy of electrons on surface of a metal or semiconductor is lower than electrons at rest in vacuum. In order to emit the electrons from any material to vacuum, energy must be supplied to the electrons inside the material. That is, the metal fails to emit electrons unless the electrons are provided with energy greater than or equal to the electrons at rest in the vacuum. Energy can be provided by numerous means, such as by heat or irradiation with light. When sufficient energy is imparted to the metal, emission occurs and the metal emits electrons. Several types of electron emission phenomena are known. Thermionic emission involves an electrically charged particle emitted by an incandescent substance (as in a vacuum tube or incandescent light bulb). Photoemission releases electrons from a material by means of energy supplied by incidence of radiation, especially light. Secondary emission occurs by bombardment of a substance with charged particles such as electrons or ions. Electron injection involves the emission from one solid to another. Finally, field emission refers to the emission of electrons due to an electric field.

In field emission, electrons under the influence of a strong electric field are injected out of a substance (usually a metal or semiconductor) into a dielectric (usually vacuum). The electrons "tunnel" through a potential barrier instead of escaping "over" it as in thermionic of photo-emission. Field emission was first correctly treated as a quantum mechanical tunneling phenomenon by Fowler and Nordheim (FN). The total emission current j is given by $$j = \frac{(1.54\times10^{-6}V^2\beta^2}{\phi t^2(y)} \exp\left(\frac{-(6.83\times10^9)\phi^{3/2}v(y)\beta d}{V}\right) \quad (1)$$

as calculated from the Schrodinger equation using the WKB approximation. For electrical fields typically applied, v(y) varies between 0.9 and 1.0, and t is very close to 1.0. Hence, as a rough approximation these functions may be ignored in equation (1), in which case it is evident that a "FN plot" of $n(j/V^2)$ vs 1/V should result in a straight line with slope—$(6.83\times10^9)\phi^{3/2}\beta d$ and intercept $(1.54\times10^{-6})\beta^2/\phi$. A more detailed discussion of the physics of field emission can be found in R. J. Noer "Electron Field Emission from Broad Area Electrodes", Appli. Phys., A-28, 1–24 (1982); Cade and Lee, "Vacuum Microelectronics", GEC J. Res. Inc., Marconi Rev., 7(3), 129 (1990); and Cutler and Tsong, Field Emission and Related Topics (1978).

For a typical metal with a phi of 4.5 eV, an electric field on the order of $10^9$ V/m is needed to get measurable emission currents. The high electric fields needed for field emission require geometric enhancement of the field at a sharp emission tip, in order that unambiguous field emission can be observed, rather than some dielectric breakdown in the electrode support dielectric materials. The shape of a field emitter effects its emission characteristics. Field emission is most easily obtained from sharply pointed needles or tips. The typical structure of a lithographically defined sharp tip for a cold cathode is made up of small emitter structures 1–2 μm in height, with submicron (<50 nm) emitting tips. These are separated from a 0.5 μm thick metal grid by a layer of silicon dioxide. Results from Stanford Research Institute ("SRI") have shown that 100 μA/tip at a cathode-grid bias of 100–200 V. An overview of vacuum electronics and Spindt type cathodes is found in the November and December, 1989, issues of IEEE Transactions of Electronic Devices. Fabrication of such fine tips, however, normally requires extensive fabrication facilities to finely tailor the emitter into a conical shape. Further, it is difficult to build large area field emitters since the cone size is limited by the lithographic equipment. It is also difficult to perform fine feature lithography on large area substrates as required by flat panel display type applications.

The electron affinity (also called work function) of the electron emitting surface or tip of a field emitter also affects emission characteristics. Electron affinity is the voltage (or energy) required to extract or emit electrons from a surface. The lower the electron affinity, the lower the voltage required to produce a particular amount of emission. If the electron affinity is negative then the surface shall spontaneously emit electrons until stopped by space charge, although the space charge can be overcome by applying a small voltage, e.g. 5 volts. Compared to the 1,000 to 2,000 volts normally required to achieve field emission from tungsten, a widely used field emitter, such small voltages are highly advantageous. There are several materials which exhibit negative electron affinity, but almost all of these materials are alkali metal-based. Alkali metals are very sensitive to atmospheric conditions and tend to decompose when exposed to air or moisture. Additionally, alkali metals have low melting points, typically below 1000° C., which is unsuitable in most applications.

For a full understanding of the prior art related to the present invention, certain attributes of diamond must also be discussed. Recently, it has been experimentally confirmed that the (111) surface of diamond crystal has an electron affinity of −0.7±0.5 electron volts, showing it to possess negative electron affinity. Diamond cold cathodes have been reported by Geis et al. in "Diamond Cold Cathode", IEEE Electron Device Letters, Vol 12, No. 8, August 1991, pp. 456–459; and in "Diamond Cold Cathodes", Applications of Diamond Films and Related Materials, Tzeng et al. (Editors), Elsevier Science Publishers B.V., 1991, pp. 309–310. The diamond cold cathodes are formed by fabricating mesa-etched diodes using carbon ion implantation into p-type diamond substrates. Recently, Kordesch et al ("Cold field emission from CVD diamond films observed in emission electron microscopy", 1991) reported that thick (100 μm) chemical vapor deposited polycrystalline diamond films fabricated at high temperatures have been observed to emit electrons with an intensity sufficient to form an image in the accelerating field of an emission microscope without external excitation (<3 MV/m). It is obvious that diamond thin film will be a low electric field cathode material for various applications.

SUMMARY OF THE INVENTION

In accordance with the present invention, a flat panel display is provided which incorporates diamond film to improve image intensity at low cost.

The present invention specifically provides for a flat panel display with a diamond field emission cathode to achieve the advantages noted above.

BRIEF DESCRIPTION OF THE DRAWINGS

For a more complete understanding of the present invention, and the advantages thereof, reference is now made to the following descriptions taken in conjunction with the accompanying drawings, in which:

FIG. 6 shows a diamond film emission cathode having multiple field emitters for each pixel;

FIG. 7*a* shows a diode biasing circuit;

FIG. 7*b* shows a typical I–V curve for a diode and an operational load-line using an internal pillar resistor of 2.5 Ohms;

FIG. 7*c* shows a timing diagram of the operation of the anode and cathode;

FIG. 8 shows the step of depositing a blanket layer of metal on a silicon substrate and a photoresist layer on the metal layer;

FIG. 9 shows the step of removing any remaining photoresist after etching;

DETAILED DESCRIPTION OF THE INVENTION

Vacuum diodes are fabricated across the expanse of a substrate employing standard fabrication techniques including deposition, masking and etching.

Figure 1:
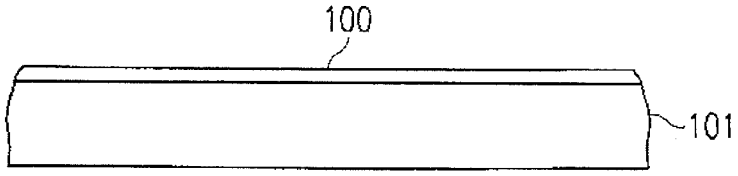
FIG. 1 shows the step of depositing a blanket layer of metal on a glass substrate and a photoresist layer on the metal layer.
Figure 2:
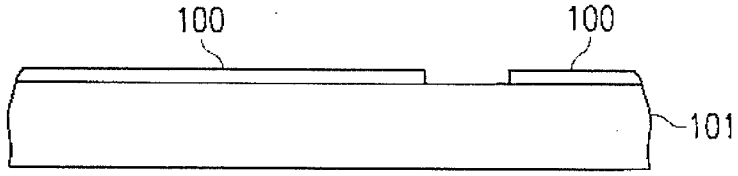
FIG. 2 shows the step of removing any remaining photoresist after etching.

Referring to FIG. 1 of the drawings, which shows a beginning step, a blanket layer 100 of 5000 Å thick chromium (which can be another metal such as molybdenum (Mo), aluminum (Al), titanium (Ti) or a combination of these) is deposited by conventional deposition technologies such as evaporation, sputtering deposition on the surface of the glass 101 (or other materials such as silicon wafer or alumina). Then a layer of photo resist is applied by spinning on to a thickness of 1 μm to 2 μm and the chromium layer 100 is delineated by mask exposure of the resist layer. The remaining resist layer 100 is a mask to etching of the chromium layer 100. The function of the chromium layer 100 is to form the addressing lines and the base for field emitters. The dimensions of the addressing line and the base are determined by different applications. For display applications, the pillar size is about 100 μm to 250 μm and the line is about 25 μm. For vacuum microelectronic devices such as high power, high frequency amplifiers, the feature size is reduced to several microns or even smaller. Finally, any remaining resist after etching is removed (see FIG. 2).

Figure 3:
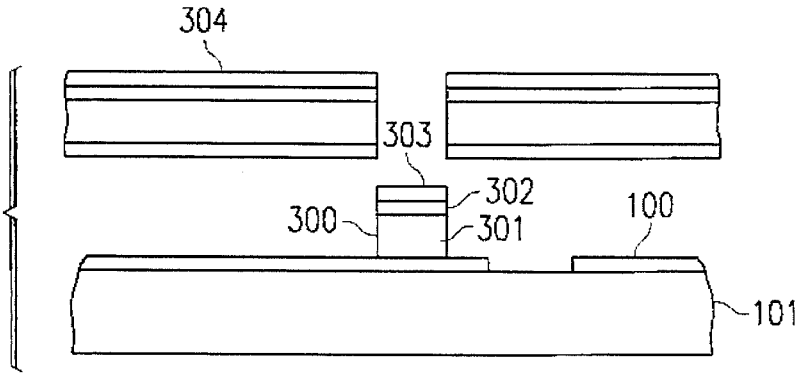
FIG. 3 shows the step of depositing conductive pillars on the layer of metal.

FIG. 3 is the cross sectional view of the next step for fabricating the display. Metal mask deposition technology is used to deposit conductive pillars 300 on top of the bases. The size of the pillars 300 is a little smaller than that of the bases. For example, if the base is 120 μm wide, the optimized size of the pillars is 100 μm wide. This requirement reduces the need for aligning the metal mask 304 to the substrate, resulting in a reduction of manufacturing cost. The height of the pillars 300 is determined by device parameters such as operating voltage, spacer size, gap between cathode and anode, and manufacturing cost. 10 μm high pillars are used here. According to the FN theory of field emission, the emission current is very sensitive to the gap between the cathode and anode and to surface conditions of the cathode. Although using the conventional thin film deposition technologies such as sputtering, evaporation and CVD, the thickness of the thin film cathode can be well controlled within 1%–5% over a large area, the uniformity of the emission current over the large area is still problematic. Assuming 4.5 eV work function of the material and 100 MV/m applied electric field used, a 1% difference in the gap between cathode and anode will cause 10% variations in the emission current. To increase the uniformity of the emission, resistive material is used to build pillars 300. The function of a resistive material is to adjust the potential across the gap between cathode and anode. The higher the pillar, the larger the resistance the pillar has and the smaller the potential across the gap. So the effect of the difference in the pillar height on the emission current is reduced or eliminated if a suitable resistor material is chosen for the pillars 300. Another function of the resistive pillars 300 is to act as a current control layer. Due to reasons such as surface conditions including contamination, roughness, and flatness, the emission current from some emitters is much higher than that of others. Due to the existence of the resistive pillar 300, the potential drop across the pillars which have higher emission current is larger than that of the pillars having smaller emission current. The optimized thickness of the resistive layer 101 in the 10 μm high pillars 300 is 5 μm.

Referring still to FIG. 3, a 5 μm thick layer 302 of a high thermal conductive material (such as copper) is deposited on the top of the resistive layer 301 through the holes in the metal mask 304 by evaporation. The function of layer 302 is to help the cathode material (here diamond) dissipate the heat generated by the emission current.

Figure 4:
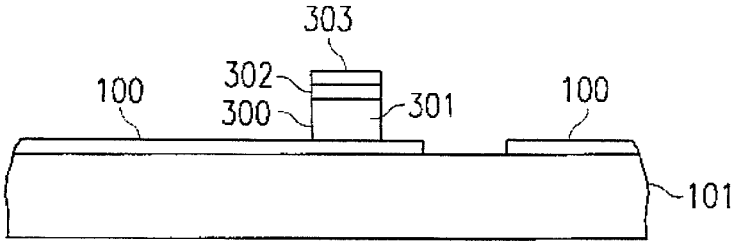
FIG. 4 shows a cross-sectional view of a diamond cathode for display applications.

In FIG. 3, diamond thin film 303 is deposited by room temperature deposition technology such as laser ablation through the holes in the metal mask 304. The thickness of the diamond 303 is about 1 micron or smaller. The low temperature restriction here is only required for a low cost display which uses regular glass as the substrate. FIG. 4 is the completed cross section view of the diamond cathode for display applications. Another way to deposit diamond thin film 303 is to use selective diamond CVD deposition technology. After fabricating the pillar 300, the thin layer of molybdenum (100 Å) is coated on the top surface of the pillar 300 using metal mask deposition technology. Then the diamond thin film 303 is only deposited on the molybdenum surface by selective CVD.

The next step is to fabricate the anode plate 500 (see FIG. 5) with an Indium Tin Oxide ("ITO") layer and phosphors by conventional thin film deposition technologies such as sputtering and evaporation or thick film technology such as screen printing. The substrate is glass. A low energy phosphor film such as zinc oxide (ZnO) is deposited and patterned on the glass with ITO coating. The fabrication process is straightforward, and need not be detailed in this disclosure.

Figure 5:
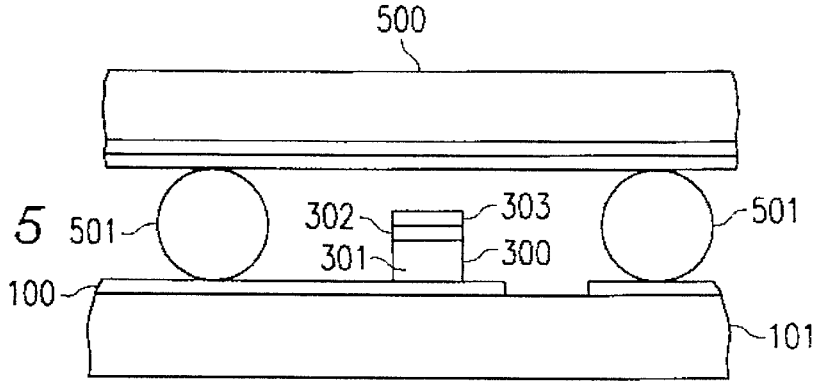
FIG. 5 shows the addition of a spacer following deposition of conductive pillars.

Referring now to FIG. 5, an assembly process of a final device is shown. The cylinder shape spacers 501 of insulator are sandwiched between the anode and cathode layer 100. The thickness of the spacers 501 is 12 μm so that the gap between cathode and anode is 2 μm. The requirements for the spacers 501 are 1) very high breakdown strength, a minimum of 100 MV/m at room temperature; 2) very uniform thickness; 3) low cost; and 4) vacuum compatible. Commercially available fibers are used as the spacers 501 for the display. There are several types of insulating fibers available at this time. The most common are optical glass and plastic fibers, and several fibers used in fiber composites. The diameter of the fiber used is around 12 μm. So the gap in the final device is 2 μm. The spacers 501 are not limited to a cylindrical shape. Furthermore, laminated layer of mica can be used in place of the fiber. The final step of fabricating the diamond flat panel display is vacuum sealing, which is standard technology. A display with a 2 μm gap between cathode and anode is designed to operate at 50–60 volts.

The operating voltage for the display described herein is limited by the threshold energy for the phosphor material. The opening voltage must be larger than the threshold energy of the phosphor. For example, regular ZnO film doped with zinc (Zn) has a threshold energy of 300 eV so that the display using this type of phosphor film needs at least 300 Volts operating voltage. The basic parameters for the display are: 20 μm gap, 10 μm pillar and 30 μm spacer. The vacuum requirement is moderate, typically $10^{-3}$ torr. FIGS. 29–32 show optical and scanning electron microscope pictures of the actual reduction to practice of FIG. 5.

With reference to FIG. 6, multiple field emitters for each pixel are designed to reduce the failure rate for each pixel, and thereby increase the lifetime of the display and manufacturing yield. Since each emitter for the same pixel has an independent resistive layer, the rest of the emitters for the same pixel will continue to emit electrons if one of the emitters on the pixel fails, whether from a short or open.

Referring to FIG. 7(*a*), a diode biasing circuit 700 and 701 is designed to drive the display with an operating voltage of 300 V by using a low voltage semiconductor driver. For full color display, the anode 500 may be patterned in three sets of stripes, each covered with a cathodoluminescent material. However, for simplicity of discussion, only one line on the anode is shown in FIG. 7(*a*). On the cathode plate, the pixels are addressed by an addressing line which is orthogonal to the line on the anode plate 500. The cathode is addressed by a 25 volt driver 701 and the anode 500 is addressed by another 25 volt driver 700 floating on a DC power supply. The output voltage from the DC power supply is chosen to be just below the threshold voltage of the display. For example, for a display with a threshold voltage of 300 V, a 250 volt DC power supply is used. By sequential addressing of these electrodes a color image can be displayed. FIG. 7(*b*) shows a typical current-voltage (I–V) curve for a diode and an operational load-line using an internal pillar resistor of 2.5 GΩ. FIG. 7(*c*) depicts the typical application of the anode and cathode voltages and the resulting anode/cathode potential.

There are several ways to fabricate diamond films. Following is a discussion of two different methods. The first method of depositing diamond and diamond-like carbon films is by laser ablation using a Nd:YAG laser bombarding a graphite target. The process has been described in detail elsewhere. FIG. 20 through FIG. 25 show field emission data taken on a sample deposited at room temperature by laser ablation. This data was taken by a tungsten carbide ball held a few microns from the film, varying the voltage applied between the ball and the sample.

Figure 26:
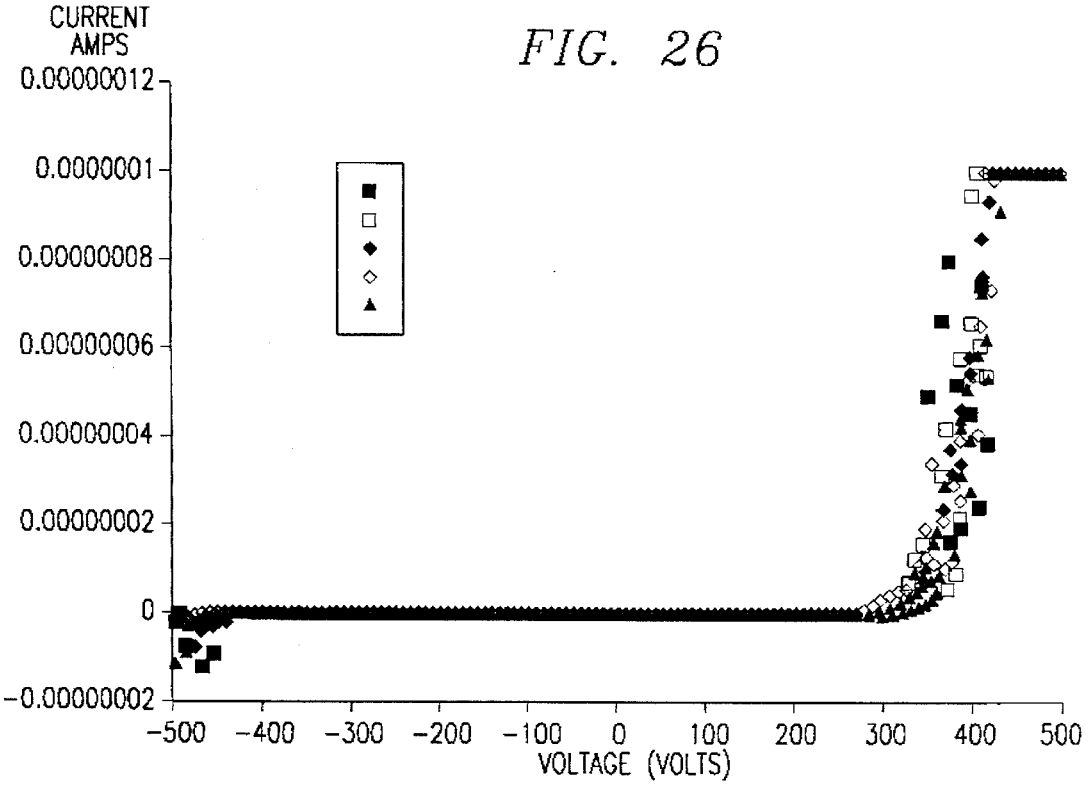
FIGS. 26 through 28 show field emission data taken on a sample formed from methane and hydrogen under conditions of high plasma.
Figure 27:
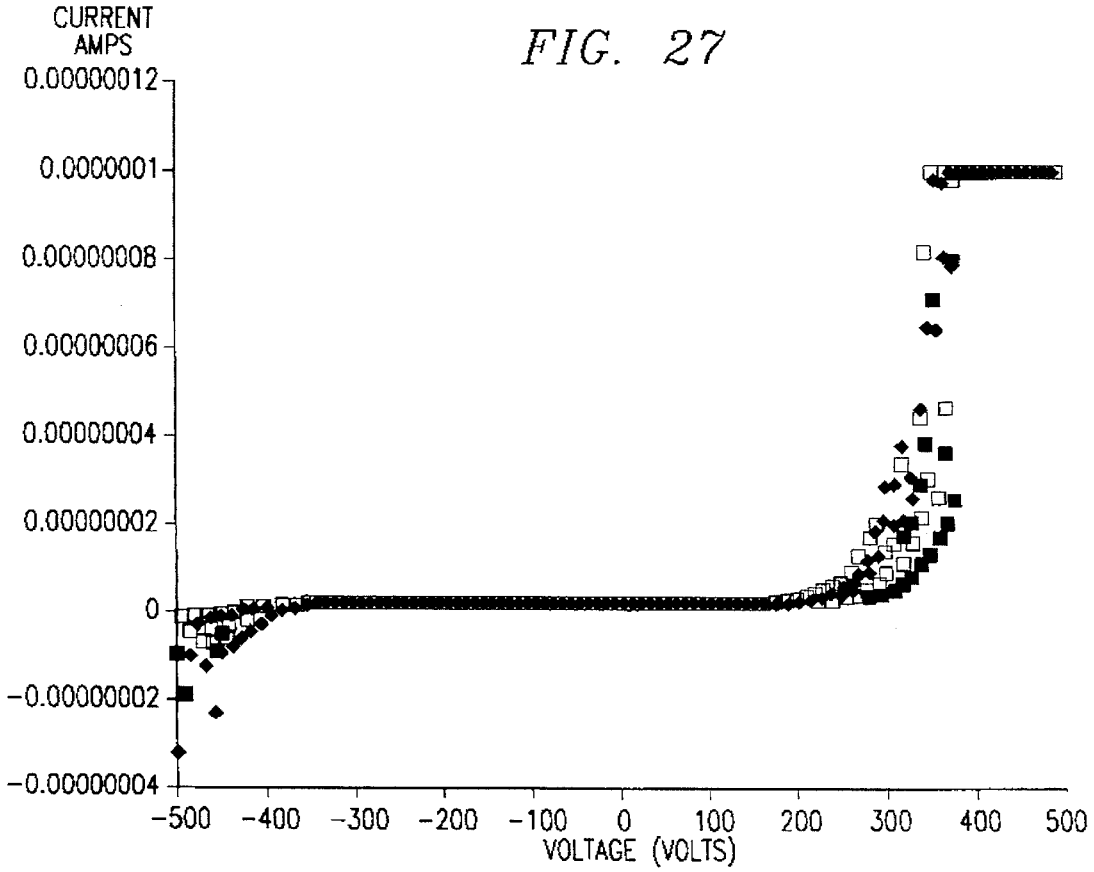
Figure 28:
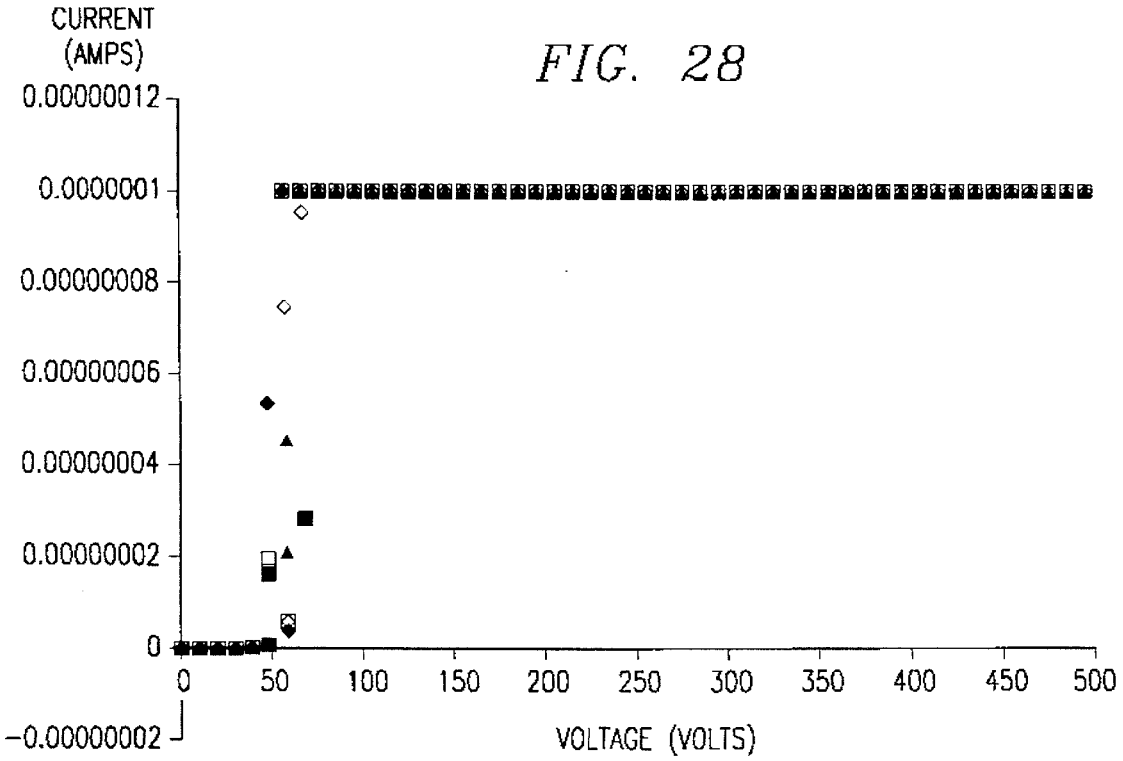
Figure 29A:
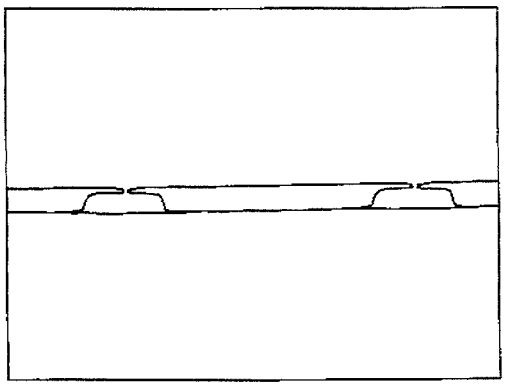
FIGS. 29*a*, 29*b*, 30*a*, 30*b*, 31*a*, 31*b*, 32*a* and 32*b* show optical and scanning electron microscopic pictures of an actual reductio to practice of a device which results after application of the processing step detailed in FIG. 5.
Figure 29B:
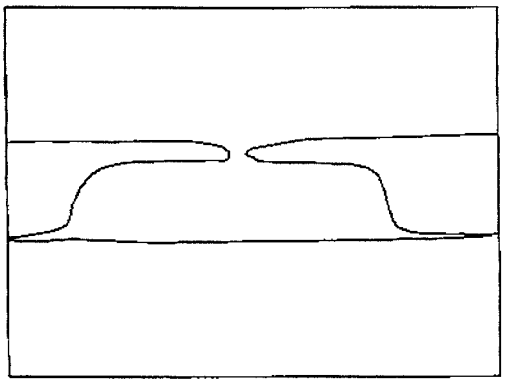
Figure 30A:
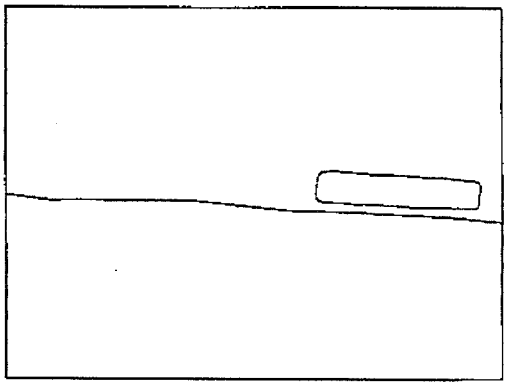
Figure 30B:
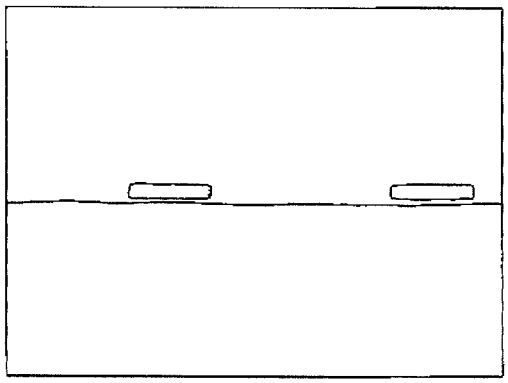
Figure 31A:
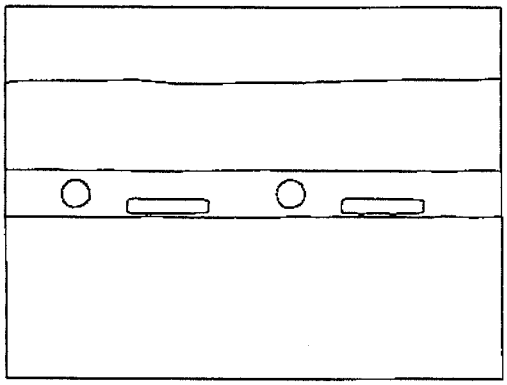
Figure 31B:
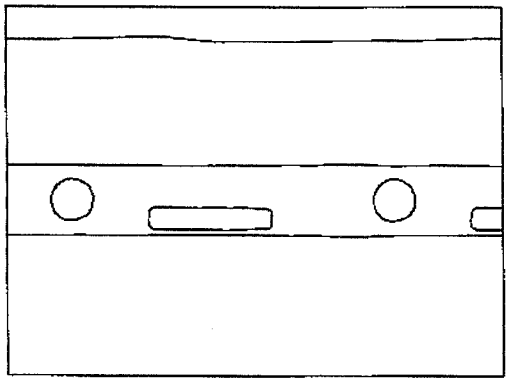
Figure 32A:
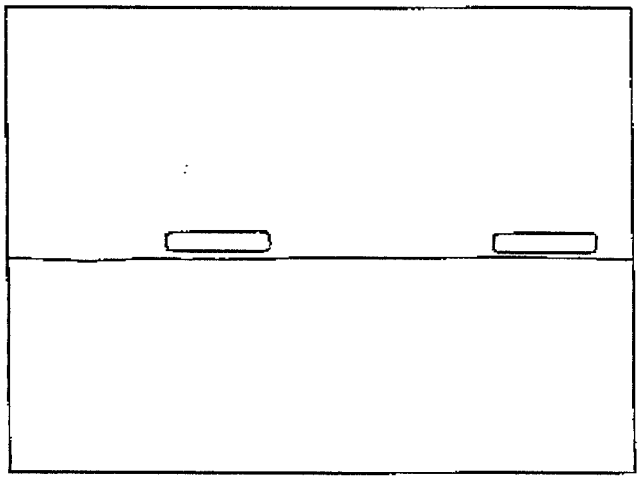
Figure 32B:
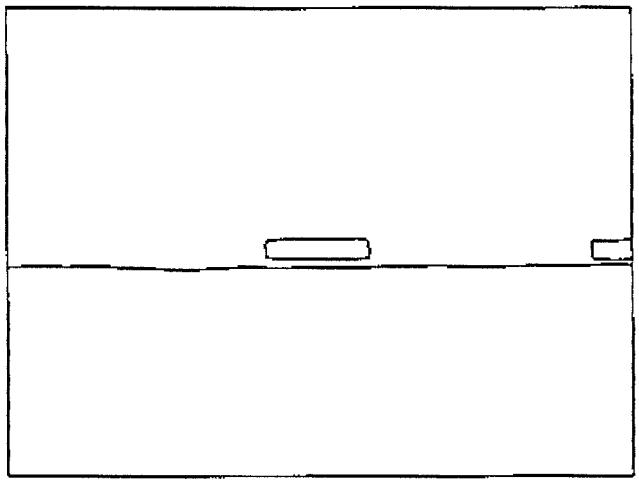

The other method of diamond fabrication is by chemical vapor deposition (CVD). In this case the diamond is formed from methane and hydrogen at very high temperature (400°–1000° C.) under conditions of high plasma. The data from such a sample is shown in FIGS. 26 through 28.

FIGS. 16 through 19 show a schematic method to fabricate a three terminal device based on diamond field emitters.

Following are variations on the basic scheme:

1) Resistors under each pixel.
2) Multiple emitters for each pixel. Independent resistors make this very useful.
3) Multiple spacers. There can be two rows of fibers: one aligned with the x-axis, and the other aligned with the y-axis. This will increase the breakdown voltage of the structure.
4) Methods for gray scale FPD. There are two methods for a diode type display. In the first case, the driver changes the voltage applied to the diode in an analog fashion, thereby changing the emission current resulting in various shades of gray. In the second approach, each of the 16 (or a similar number) emitter pillars of each pixel is individually addressed. In this way the current reaching the phosphor can be varied.
5) Even though all the structures shown herein use diamond field emitters, any other low electron affinity material may be used as well. These include various cermet and oxides and borides.
6) Conditioning. All diamond samples need to be conditioned at the beginning of field emission. This involves application of a higher voltage which conditions the emitter surface. After initial conditioning, the threshold voltage for the emitter drops drastically and the emitter operates at that voltage. There may be other methods of conditioning such as thermal activation or photo-conditioning. The displays may require periodic conditioning which may be programmed in such a way that the whole display is conditioned whenever the display is turned on.

There are other applications for diamond cathode field emitters, namely diamond cathodes for a vacuum valve. The structure of micron or submicron vacuum microelectronics with a diamond thin film cathode will be described.

There are many applications of vacuum microelectronics, but they all rely on the distinctive properties of field emitting devices. Vacuum valves do still exist and a great deal of effort has, for many years, been directed towards finding a cold electron source to replace the thermionic cathode in such devices as cathode ray tubes, traveling wave tubes and a range of other microwave power amplifiers. This search has focused particularly on faster start-up, higher current density and lower heater power. Field emission cathodes offer the promise of improvements in all three, resulting in increased operating power and greater efficiency. For example, the high power pulse amplifier used as a beacon on a transmitter for air traffic control has a 6 mm diameter thermionic cathode giving a beam diameter of 3 mm and is capable of a maximum current density of 4 A/cm$^2$. The field emission diode required to obtain an equivalent current would be less than 0.05 mm in diameter. It is clear, however, that if this diode were used in such a traveling wave tube, provisions would have to be made to avoid back bombardment of emitting tips by energetic ions. There has also been growing concern over the ability of solid state electronics to survive in space and over defense systems where they are exposed to both ionizing and electromagnetic radiation. Most semiconductor devices rely on low voltage transport of low density electron gas. When exposed to ionizing radiation, they are bombarded by both neutral and charged particles, which causes both excitation of carriers, changing this density, and trapping of charge at insulator interfaces, leading to significant shifts in bias voltage. The result may be transient upset, or permanent damage if the shifted characteristic leads to runaway currents. The most sensitive insulator involved in a vacuum device is the vacuum itself which will not be permanently damaged by radiation or current overloading.

In addition, the speed of a semiconductor device is ultimately limited by the time taken for an electron to travel from the source to the drain. The transit time is determined by impurity and phono collisions within the lattice of the solid, which lead to electron velocity saturation at about the speed of sound. Vacuum valves, however, operate by electrons passing from cathode to anode within a vacuum and their passage is therefore unimpaired by molecular collisions. With typical voltages (100 V) and dimensions (1 μm), transit times of less than 1 picosecond can be expected.

Thus, there is a need for a structure of related field emission devices for different applications and a method of making.

Vacuum diodes are fabricated by semiconductor style fabrication technology, allowing micron or submicron dimensional control.

Similar to FIG. 1, FIG. 8 shows a beginning step for submicron or micron vacuum valves. A blank layer 800 of 500 Å thick Al (which can be another metal) is deposited by conventional deposition technologies such as evaporation or sputtering on a silicon wafer 801. In FIG. 9, a layer 802 of photo resist is applied by spinning on to a thickness of 1 μm to 2 μm and a chromium layer is delineated by mask exposure to the resist layer. The remaining resist layer is a mask to etching to the Al layer 800. The functions of the Al layer 800 are addressing lines and the base for the field emitter. The dimensions of the addressing line and the base are determined by the different applications. For submicron vacuum values applications, the pillar size is about 1 μm to 2 μm or even less and the line is about 0.1 μm. Finally, the remaining resist on the addressing line is removed by using a second mask and etching process.

Figure 10:
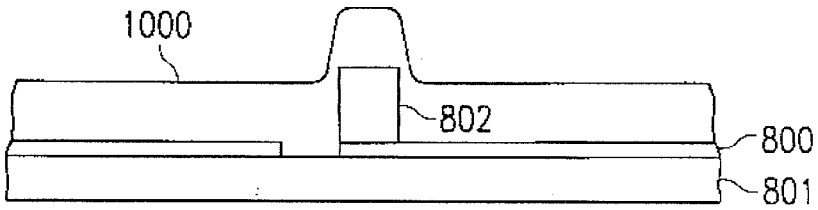
FIG. 10 shows the step of depositing conductive pillars on the layer of metal.
Figure 11:
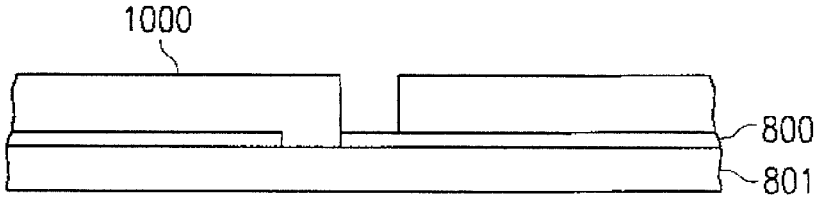
FIG. 11 shows a cross-sectional view of a diamond cathode for display applications.

FIG. 10 is the cross sectional view of the next step for fabricating submicron vacuum valves. An $SiO_2$ layer 1000 of thickness of 1 μm is deposited by thermal Chemical Vapor Deposition ("CVD") on the substrate. Then in FIG. 11 the remaining resist 802 on the pillar is removed by etching process. FIG. 11 is the cross sectional view of the structure at the second stage.

For the same reasons discussed before, the resistive layer is introduced between the cathode layer (diamond thin film) and the base layer (Al layer). In this disclosure, we use diamond as the cathode material as well as resistive material. The wide energy gap of diamond (5.45 eV) at room temperature is responsible for the high breakdown field of diamond and excellent insulation. It also provides the opportunity to fabricate the diamond thin film with a wide range of resistivity. The closer the doping level to the conductance band or valence band, the lower the resistivity the film has. Attempts to dope diamonds by admixing PH3 were partially successful. Activation energies in the range 0.84–1.15 eV were obtained. Hall effect measurements indicate that phosphorus doped samples have n-type conductivity. Although the resistivity of phosphorous doped films is usually too high for electronic applications, it fits for the resistive layer in the vacuum microelectronics. Sodium (Na) is a potential shallow donor and occupies the tetrahedrally interstitial site. The formation energy for sodium is about 16.6 eV with respect to experimental cohesive energies of bulk Na. As a result the solubility of sodium in diamond is quite low and the doping is performed by ion implantation or some other ion beam technology.

Figure 12:
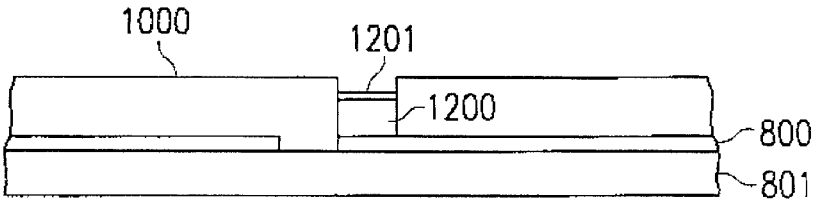
FIG. 12 shows the step of selectively depositing a phosphorus-doped diamond thin film.

Referring to FIG. 12, phosphorus doped diamond thin film 1200 is selectively deposited by plasma CVD technology on the base layer 800. The system used for diamond deposition has an extra gas inlet for doping gas and an ion beam for sodium doping. At first, the ion beam is standby and the gas inlet for PH3 is open. The donor concentration in the diamond is controlled by the flow rate of PH3. The phosphorus concentration in diamond can be varied in the range 0.01–1 wt % depending on the device parameters. The thickness of the phosphorus-doped diamond thin film 1200 is 0.5 μm. After the thickness of phosphorus-doped diamond thin film 1200 reaches the desired value, the PH3 gas line shuts off and the ion beam for sodium starts to dope the sodium while plasma CBD deposition of diamond thin film 1201 is continuous. The thickness of heavy-doped n-diamond thin film 1201 with a sodium donor is about 100 Å. The difference between the thickness of $SiO_2$ 1000 and the diamond thin film 1201 is about 0.5 μm.

Figure 13:
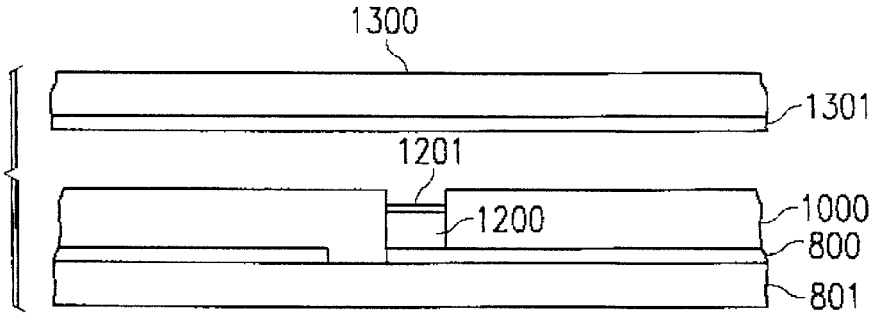
FIG. 13 shows the step of assembling an anode and cathode together.

Referring now to FIG. 13, the silicon wafer 1300 with metallization layer 1301 is fabricated by standard semiconductor technology as an anode plate and both substrates, anode and cathode, are assembled together. The assembly is pumped down to a certain pressure (for example $10^{-3}$ torr) and sealed with vacuum compatible adhesive. The pressure inside the devices is determined by the geometry of the devices and the operating voltage. If the operating voltage is lower than the ionization potential which is less than 10 Volts and the gap between the cathode and anode is less than electron mean free path at atmosphere (0.5 μm), the procedure for vacuum sealing the device can be eliminated. Otherwise, the pressure inside the device should be kept at $10^{-3}$ torr.

Following is a description for diamond coating for a microtip type vacuum triode.

Figure 14:
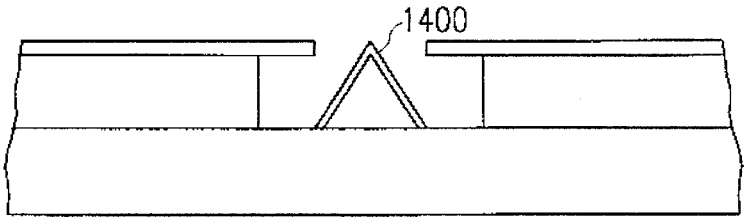
FIG. 14 shows a multielectrode configuration for triode operation.

FIG. 14 shows a multielectrode configuration for triode operation. The detail of the structure and fabrication process have been well known for many years. For purposes of the present invention the well-known process to fabricate the microtips and coat the tips with diamond thin film 1400 of 100 Å thickness by using selective CVD deposition is followed. The diamond coating results in the reduction of the operating voltage from 135 volts to 15 volts since the threshold electric field for diamond is much lower than that for any refractory metal.

Figure 15:
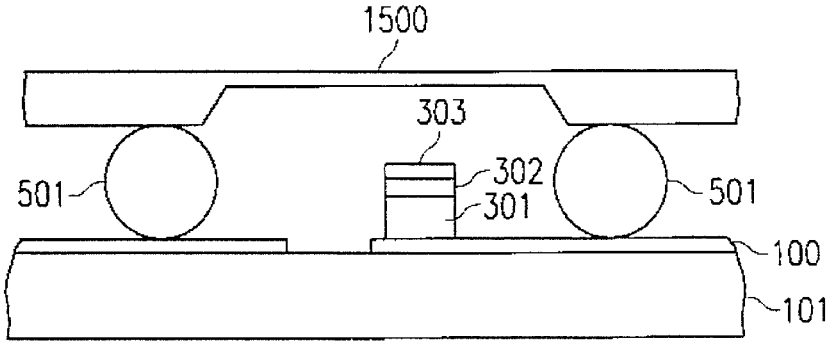
FIG. 15 shows a structure of a sensor having a diamond cathode.
Figure 16:
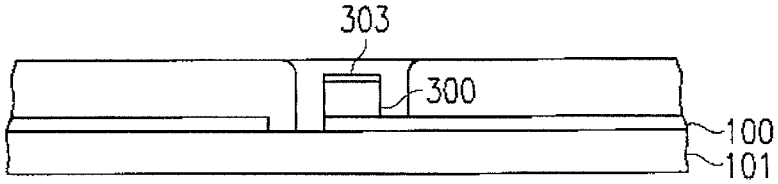
FIGS. 16 through 19 show a schematic method to fabricate a three terminal device based on diamond field emitters.
Figure 17:
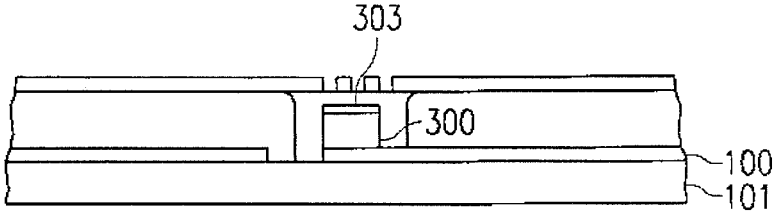
Figure 18:
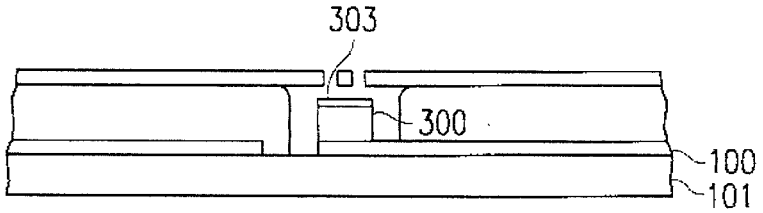
Figure 19:
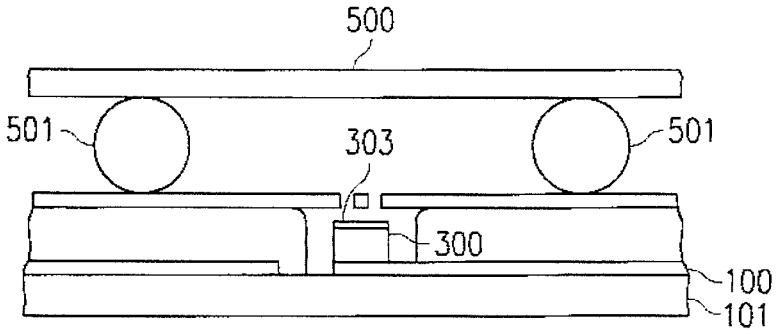
Figure 20:
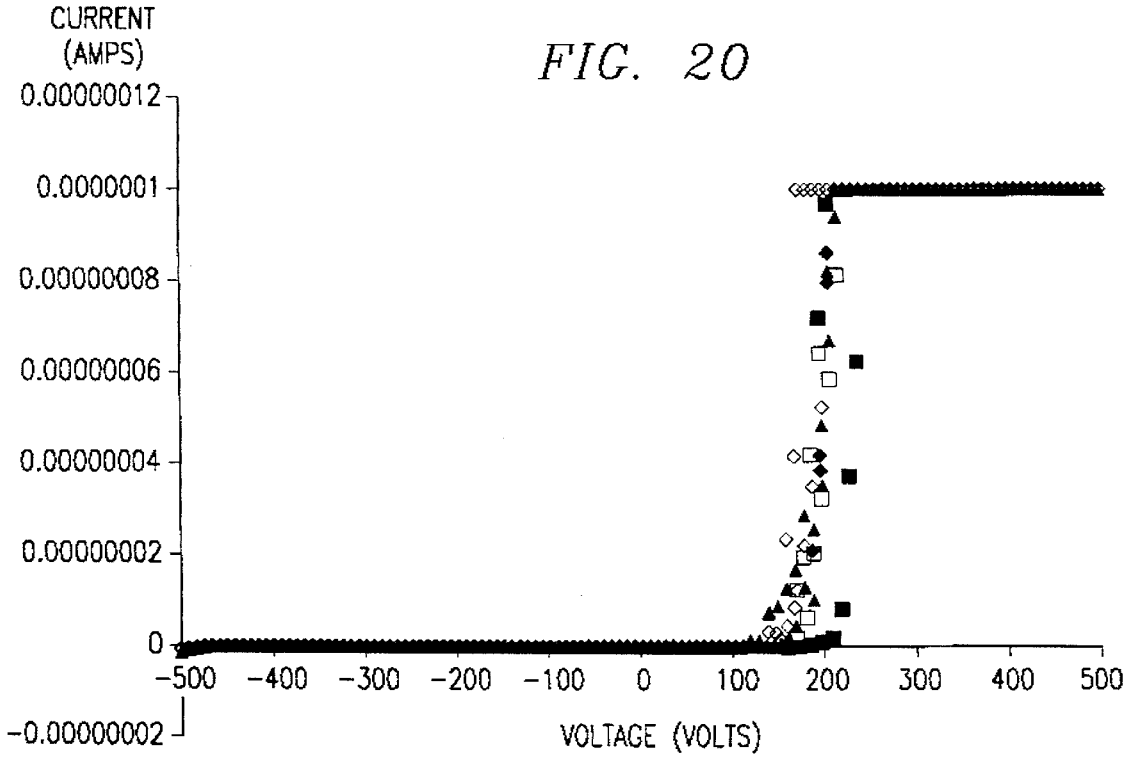
FIGS. 20 through 25 show field emission data taken on a sample deposited at room temperature by laser ablation.
Figure 21:
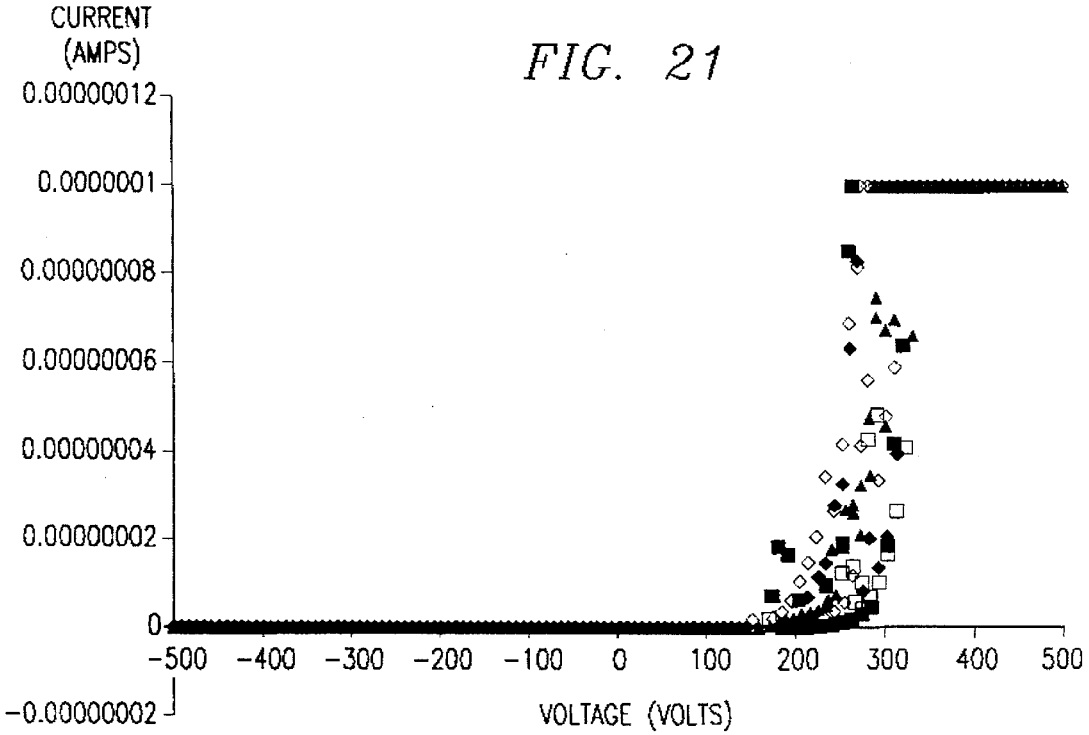
Figure 22:
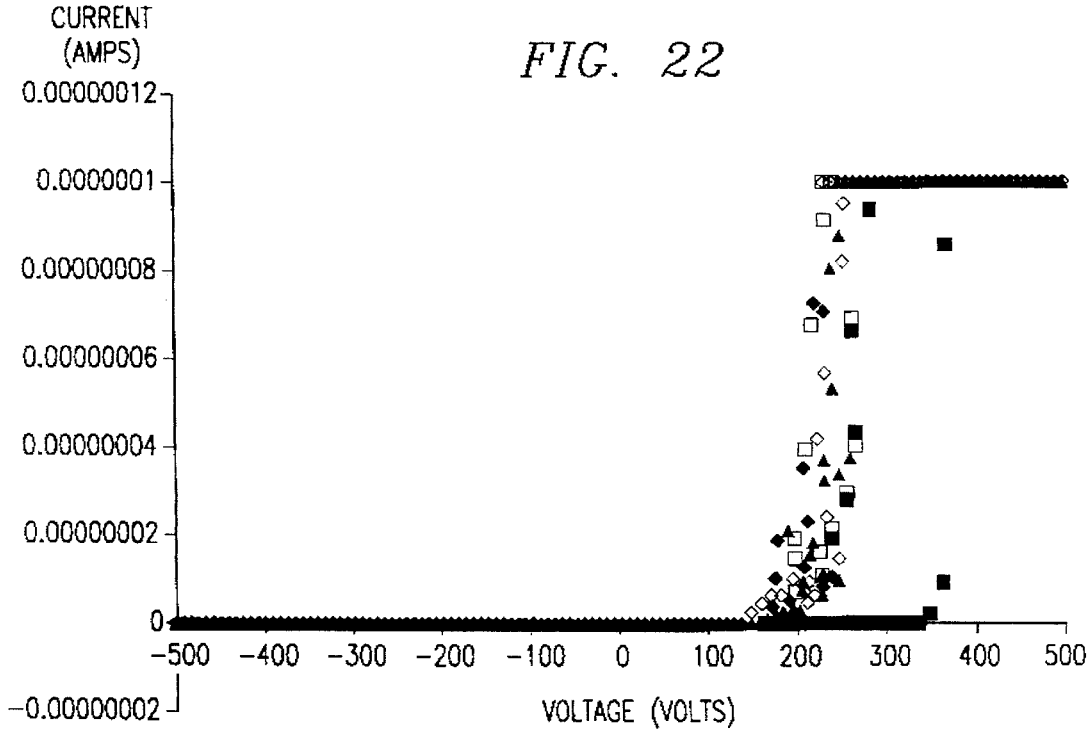
Figure 23:
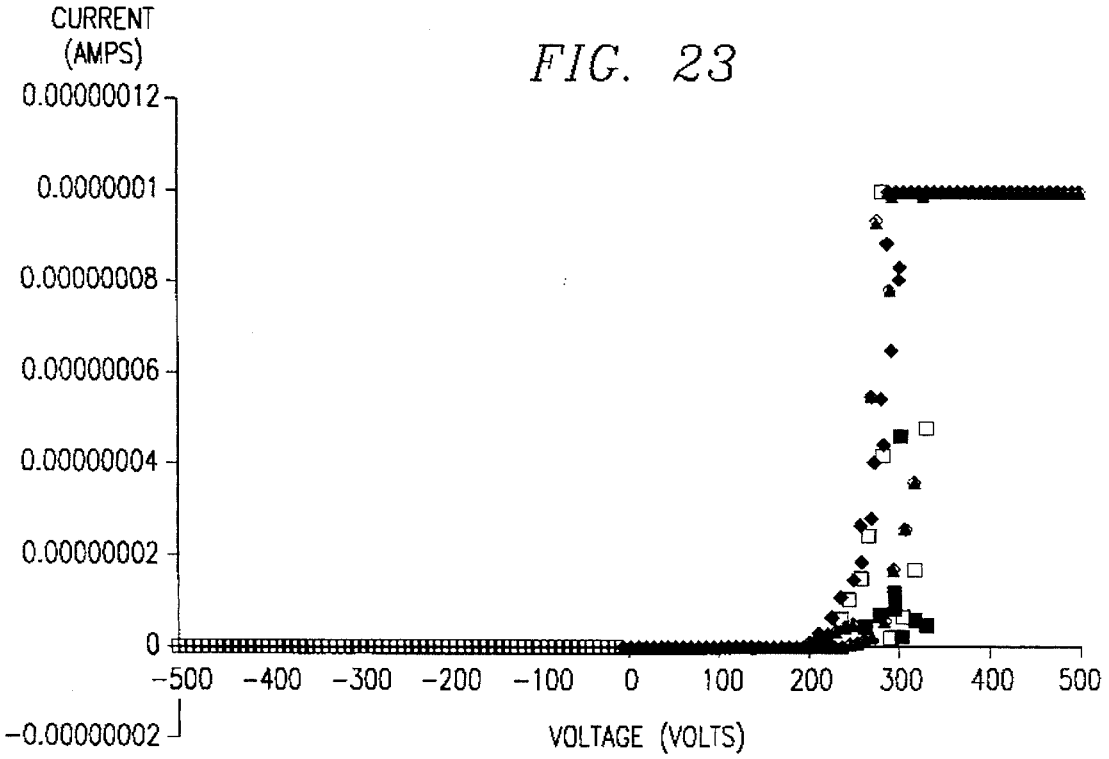
Figure 24:
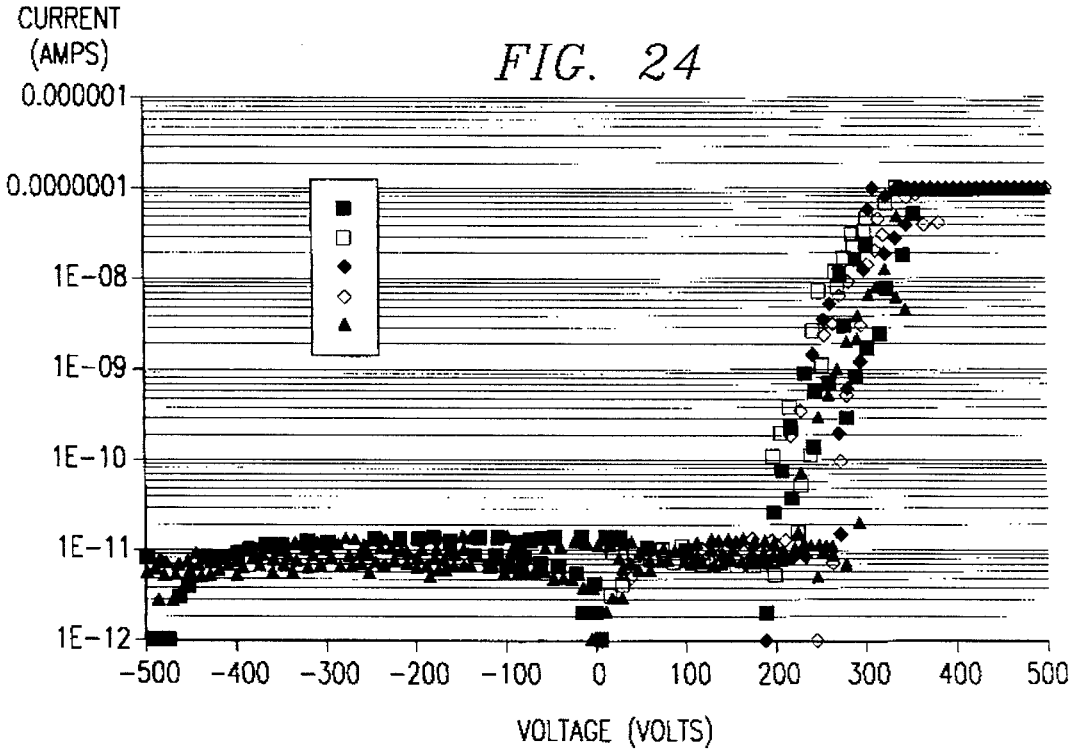
Figure 25:
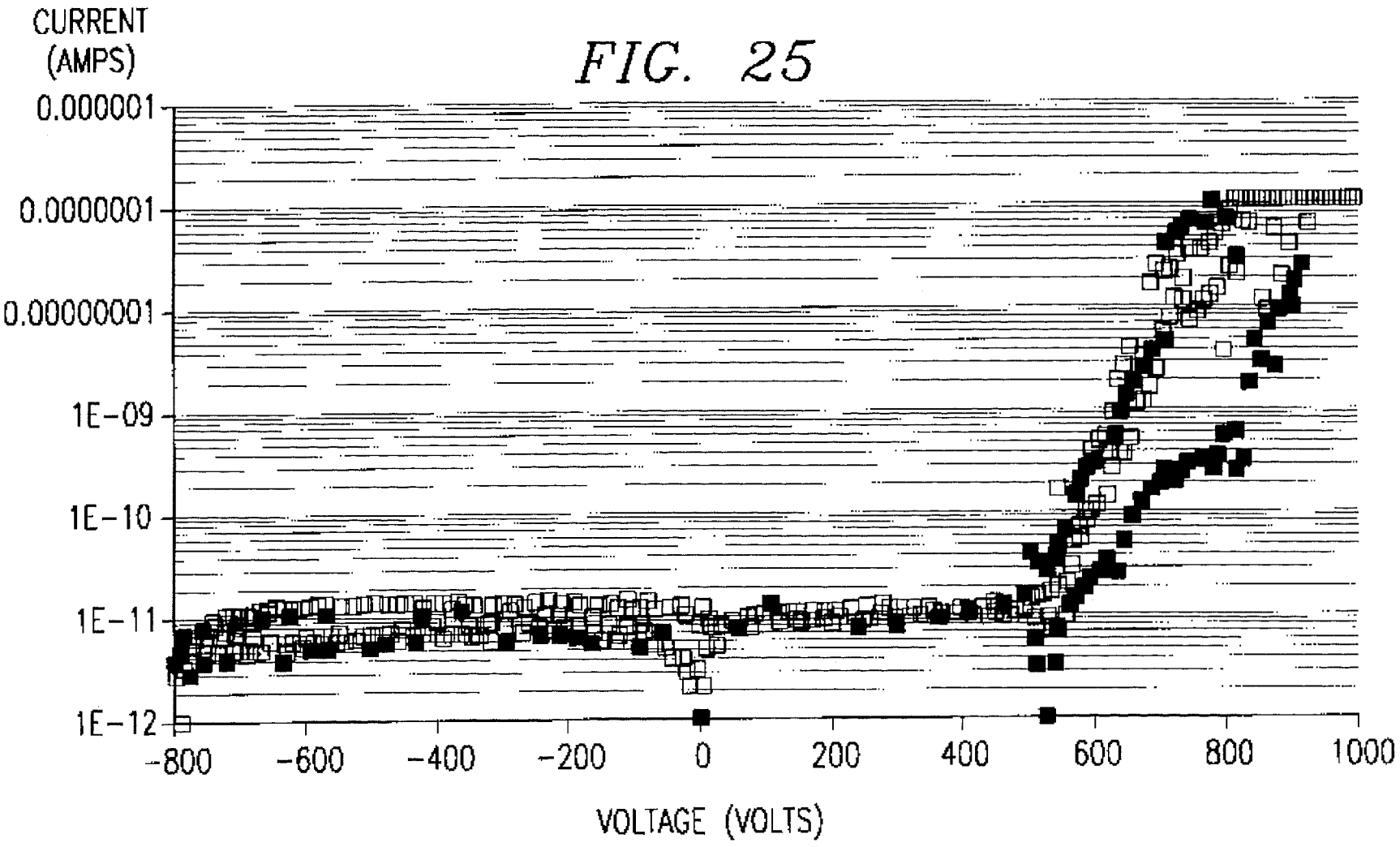

FIG. 15 shows the structure of a sensor with a diamond cathode. The fabrication process is similar to that for vacuum diodes. The only difference is the anode plate 1500. The anode plate 1500, made of a very thin silicon membrane, is deflected by any applied pressure or force, which changes the distance between the anode and the cathode, thereby changing the current which can be measured.

Although direct competition between silicon semiconductor electronics and vacuum electronics based on the field emission cathode is unlikely, the two technologies are not incompatible. It is therefore conceivable that electronic systems incorporating both semiconductor and vacuum devices, possibly even on the same chip, will be possible. Such a hybrid could exploit the high speed of vacuum transport.

In the same chip, solid state devices are made of silicon and vacuum electronics based on non-silicon cathode material. The fabrication process for hybrid chips is very high cost and complicated since two types of the basic material are used and different processes are involved. Diamond possesses a unique combination of desirable properties which make it attractive for a variety of electronics. With the present invention, a chip based on diamond solid state electronics and diamond vacuum electronics is fabricated.

Although the present invention and its advantages have been described in detail, it should be understood that various changes, substitutions and alterations can be made herein without departing from the spirit and scope of the invention as defined by the appended claims.

What we claim is:

1. A field emission cathode, comprising:

a substrate;

a conductive layer disposed adjacent said substrate;

an electrically resistive pillar disposed adjacent said conductive layer, said resistive pillar having a substantially flat surface spaced from and substantially parallel to said substrate and at least one entirely exposed sidewall extending from said conductive layer to said flat surface of said pillar; and a layer of cathode material disposed adjacent said surface of said resistive pillar, and having a substantially flat exposed surface spaced from and substantially parallel to said substrate.

2. The cathode as recited in claim 1 wherein said material has a negative electron affinity.

3. The cathode as recited in claim 1 wherein said substrate is glass.

4. The cathode as recited in claim 1 wherein said substrate is silicon.

5. The cathode as recited in claim 1 where said conductive layer is formed of chromium.

6. The cathode as recited in claim 1 wherein said material is diamond film.

7. The cathode as recited in claim 6 wherein said diamond film comprises laser ablated diamond.

8. The cathode as recited in claim 6 wherein said diamond film comprises chemical vapor deposition diamond.

9. The cathode as recited in claim 1 wherein said conductive layer, said resistive pillar and said material form a path for electrical current.

10. The cathode as recited in claim 1 wherein said resistive pillar regulates current fed to said material.

11. The cathode as recited in claim 1 wherein said material has a low electron affinity.

12. The cathode as recited in claim 1 wherein said resistive pillar is comprised of said cathode material.

13. The cathode as recited in claim 1 wherein said pillar is comprised of a heat sink material.

14. The cathode as recited in claim 13 wherein said heat sink material is comprised of copper.

15. A field emission cathode assembly, comprising:

a plurality of spaced apart field emission cathodes adjacent a substrate, each of said field emission cathodes comprising:

an electrically resistive pillar spaced from said substrate by a layer of metal, said resistive pillar having a substantially flat surface spaced from and substantially parallel to said substrate and at least one entirely exposed sidewall extending from said layer of metal to said substantially flat surface of said pillar; and a layer of cathode material disposed adjacent said surface of said resistive pillar and having a substantially flat exposed surface spaced from and substantially parallel to said substrate; and an anode spaced from said layer of cathode material of each said cathode by a gap, a width of each said gap defined by a height of a corresponding said pillar, a resistance of each said pillar proportionate to said height of said pillar such that a potential across each said gap is substantially the same.

16. The assembly as recited in claim 15 wherein said material has a negative electron affinity.

17. The assembly as recited in claim 15 wherein said assembly further comprises a spacer material spacing said field emission cathodes.

18. The assembly as recited in claim 17 wherein said spacer material is fibrous.

19. The assembly as recited in claim 15 wherein said anode includes a second substrate and an indium tin oxide layer deposited deposited adjacent said second substrate.

20. The assembly as recited in claim 19 further comprising a phosphor film layer deposited adjacent indium tin oxide layer to produce thereby an anode assembly.

21. The assembly as recited in claim 19 wherein said phosphor layer comprises zinc oxide.

22. The assembly as recited in claim 19 wherein said phosphor layer is deposited in a pattern.

23. The assembly as recited in claim 20 wherein said cathode and anode assemblies are joined to form a portion of a flat panel display.

24. The assembly as recited in claim 23 wherein said joined cathode and anode assemblies are separated by an electrical potential provided by a diode biasing circuit.

25. The assembly as recited in claim 19 wherein said second substrate is a transparent material.

26. The assembly as recited in claim 25 wherein said second substrate is glass.

27. The assembly as recited in claim 26 wherein said pattern defines a plurality of lines of phosphor.

28. A field emission cathode, comprising:

a substrate;

a conductive layer disposed adjacent said substrate;

an electrically resistive pillar disposed adjacent said conductive layer, said resistive pillar having a substantially flat surface spaced from and substantially parallel to said substrate and at least one entirely exposed sidewall extending from said conductive layer to said flat surface of said pillar; and a layer of cathode material having a substantially flat surface and disposed adjacent said surface of said resistive pillar, wherein said resistive pillar is comprised of said cathode material, and wherein said resistive pillar and said cathode material both comprise diamond.

* * * * *

UNITED STATES PATENT AND TRADEMARK OFFICE

CERTIFICATE OF CORRECTION

PATENT NO. : 5,543,684
DATED : August 6, 1996
INVENTOR(S) : Kumar et al.

It is certified that error appears in the above-indentified patent and that said Letters Patent is hereby corrected as shown below:

In the title page, section [56], References Cited, please add the following references under U.S. PATENT DOCUMENTS:

--3,812,559 05/28/74 Spindt et al.
3,947,716 03/30/76 Fraser, Jr. et al.
3,970,887 07/20/76 Smith et al.
4,141,405 02/27/79 Spindt
4,143,292 03/06/79 Hosoki et al.
4,307,507 12/29/81 Gray et al.
4,822,466 04/18/89 Rabalais et al.
4,851,254 07/25/89 Yamamoto et al
4,855,636 08/08/89 Busta et al.
4,857,161 08/15/89 Borel et al.
4,964,946 10/23/90 Gray et al.
4,987,007 01/22/91 Wagal et al.
5,038,070 08/06/91 Bardai et al
5,064,396 11/12/91 Spindt
5,089,742 02/18/92 Kirkpatrick et al.
5,090,932 02/25/92 Dieumegard et al.
5,098,737 03/24/92 Collins et al.
5,129,850 07/14/92 Kane et al.
5,138,237 08/11/92 Kane et al.
5,141,459 08/25/92 Zimmerman
5,151,061 09/29/92 Sandhu
5,183,529 02/02/93 Potter et al.
5,186,670 02/16/93 Doan et al.
5,199,918 04/16/93 Kumar
5,203,731 04/20/93 Zimmerman
5,228,878 07/20/93 Komatsu
5,229,331 07/20/93 Doan et al.
5,250,451 10/05/93 Chouan

UNITED STATES PATENT AND TRADEMARK OFFICE

CERTIFICATE OF CORRECTION

PATENT NO. : 5,543,684

DATED : August 6, 1996

INVENTOR(S) : Kumar et al.

It is certified that error appears in the above-indentified patent and that said Letters Patent is hereby corrected as shown below:

5,259,799 11/09/93 Doan et al.
5,275,967 01/04/94 Taniguchi et al.
5,277,638 01/11/94 Lee
5,278,475 01/11/94 Jaskie et al.
5,312,514 05/17/94 Kumar
5,380,546 01/10/95 Kirshnan et al.
3,755,704 08/28/73 Spindt et al.
3,855,499 12/17/74 Yamada et al.
4,075,535 02/21/78 Genequand et al.
4,139,773 02/13/79 Swanson
4,168,213 09/18/79 Hoeberechts
4,350,926 09/21/82 Shelton
4,513,308 04/23/85 Greene et al.
4,578,614 03/25/86 Gray et al.
4,685,996 08/11/87 Busta et al.
4,721,885 01/26/88 Brodie
4,728,851 03/01/88 Lambe
4,835,438 05/30/89 Baptist et al
4,874,981 10/17/89 Spindt
4,908,539 03/13/90 Meyer
4,933,108 06/12/90 Soredal
5,019,003 05/28/91 Chason
5,063,323 11/05/91 Longo et al.
5,089,292 02/18/92 MaCaulay et al.
5,157,309 10/20/92 Parker et al.
5,194,780 03/16/93 Meyer
5,199,917 04/06/93 MacDonald et al.
5,202,571 04/13/93 Hinabayashi et al.

UNITED STATES PATENT AND TRADEMARK OFFICE

CERTIFICATE OF CORRECTION

PATENT NO. : 5,543,684

DATED : August 6, 1996

INVENTOR(S) : Kumar et al.

It is certified that error appears in the above-indentified patent and that said Letters Patent is hereby corrected as shown below:

5,204,581 04/20/93 Andreadakis et al.
5,228,877 07/20/93 Allaway et al.
5,229,682 07/20/93 Komatsu
5,235,244 08/10/93 Spindt
5,243,252 09/07/93 Kaneko et al.
5,252,833 10/12/93 Kane et al.
5,256,888 10/26/93 Kane
5,281,891 01/25/94 Kaneko et al.
5,285,129 02/08/94 Takeda et al.
4,684,353 08/04/87 deSouza
5,132,585 07/21/92 Kane et al.
5,117,267 05/26/92 Kimoto et al.
5,119,386 06/02/92 Narusawa
5,210,430 05/11/93 Taniguchi et al.
4,594,527 06/10/86 Genevese
4,540,983 09/10/85 Morimoto et al.
4,763,187 08/09/88 Biberian
5,101,288 03/31/92 Ohta et al.
5,117,299 05/26/92 Kondo et al
5,132,676 07/21/92 Kimura et al.
5,153,753 10/06/92 Ohta et al.
5,214,416 05/25/93 Kondo et al.
4,788,472 11/29/88 Katakami
4,588,921 05/13/86 Tischer
4,710,765 12/01/87 Ohkoshi et al.
4,857,799 08/15/89 Spindt et al.
4,882,659 11/21/89 Gloudemans
4,899,081 02/06/90 Kishino et al.
4,923,421 05/08/90 Brodie et al.

UNITED STATES PATENT AND TRADEMARK OFFICE

CERTIFICATE OF CORRECTION

PATENT NO. : 5,543,684

DATED : August 6, 1996

INVENTOR(S) : Kumar et al.

It is certified that error appears in the above-indentified patent and that said Letters Patent is hereby corrected as shown below:

5,015,912 05/14/91 Spindt et al.
5,036,247 07/30/91 Watanabe et al.
5,054,047 10/01/91 Shoulders
5,055,744 10/08/91 Tsuruoka
5,063,327 11/05/91 Brodie et al.
5,075,591 12/24/91 Holmberg
5,103,144 04/07/92 Dunham
5,103,145 04/07/92 Doran
5,148,461 09/15/92 Shoulders
5,212,426 05/18/93 Kane
5,283,500 02/01/94 Kochanski
4,507,562 03/26/85 Braunlich et al.
4,542,038 09/17/85 Odaka et al.
4,684,540 08/04/87 Schulze
4,687,825 08/18/87 Sagou et al.
4,758,449 07/19/88 Kimura et al.
4,816,717 03/28/89 Harper, et al.
4,889,690 12/26/89 Lubbers et al.
4,892,757 01/09/90 Kasenga et al.
4,956,202 09/11/90 Kasenga et al.
4,994,205 02/19/91 Towers
5,085,958 02/04/92 Jeong
5,124,072 06/23/92 Dole et al.
5,124,558 06/23/92 Soltani et al.
5,166,456 11/24/92 Masahiko
5,204,021 04/20/93 Dole
5,242,620 09/07/93 Dole et al.
5,302,423 04/12/94 Tran et al.
5,150,011 09/22/92 Fujieda

UNITED STATES PATENT AND TRADEMARK OFFICE

CERTIFICATE OF CORRECTION

PATENT NO. : 5,543,684

DATED : August 6, 1996

INVENTOR(S) : Kumar et al.

It is certified that error appears in the above-indentified patent and that said Letters Patent is hereby corrected as shown below:

5,075,591 12/24/91 Holmberg
5,089,812 02/17/89 Fuse
5,276,521 01/04/94 Mori et al
3,675,063 07/04/72 Spindt et al.
4,178,531 12/11/79 Alig
4,926,056 05/15/90 Spindt
5,054,046 10/01/91 Shoulders
5,123,039 06/16/92 Shoulders
5,142,390 08/25/92 Ohta et al.
5,153,901 10/06/92 Shoulders Signed and Sealed this Second Day of December, 1997

*Attest:*

Bruce Lehman

BRUCE LEHMAN

*Attesting Officer*

*Commissioner of Patents and Trademarks*